United States Patent [19]

Ortega

[11] 4,019,139

[45] Apr. 19, 1977

[54] INTERACTION MULTI-STATION ALARM SYSTEM

[76] Inventor: Jose I. Ortega, 212 W. Cammack, Shawnee, Okla. 74801

[22] Filed: Apr. 28, 1975

[21] Appl. No.: 572,386

[52] U.S. Cl. ..... 325/16; 325/55; 325/364; 325/466; 340/224; 340/311; 340/312

[51] Int. Cl.[2] ..... H01B 1/38

[58] Field of Search ..... 340/312, 311, 224; 325/51, 55, 64; 325/16, 364, 466

[56] References Cited

UNITED STATES PATENTS

| | | | |
|---|---|---|---|
| 2,535,162 | 12/1950 | Rodgers | 340/312 |
| 3,131,354 | 4/1964 | Battin | 325/466 |
| 3,517,316 | 6/1970 | Anderson | 340/224 |
| 3,588,858 | 6/1971 | Demuth | 325/64 |
| 3,739,329 | 6/1973 | Lester | 340/312 |
| 3,772,668 | 11/1973 | Smith | 340/312 |
| 3,818,345 | 6/1974 | Miya | 325/64 |
| 3,864,674 | 2/1975 | Worsham | 325/64 |

*Primary Examiner*—Thomas B. Habecker
*Attorney, Agent, or Firm*—Laney, Dougherty, Hessin & Fish

[57] ABSTRACT

A method and apparatus for providing vigilance alarm in or about a multiple station installation as may be used basically in an apartment complex or neighborhood but may be extended to include any number of station alerts wherein an undesired disturbance at one station will be made known with characteristic identification at all remaining stations in the system. The apparatus includes at each station a similar type of unit which consists of a radio transmitter and receiver, the transmitter of which can be energized to transmit an alarm signal indicative of that particular station to all receivers of remaining stations; and receivers of remaining stations thereafter energize frequency selective response circuitry in order to indicate and give audible alarm of disturbance at the transmitting station.

7 Claims, 2 Drawing Figures

INTERACTION MULTI-STATION ALARM SYSTEM

BACKGROUND OF THE INVENTION

1. FIELD OF THE INVENTION

The invention relates generally to alarm systems and, more particularly, but not by way of limitation, it relates to an improved alarm system of a type which transmits indication from a disturbed station to all remaining stations in a multiple station system.

2. DESCRIPTION OF THE PRIOR ART

The prior art includes numerous types of mechanical and/or electrical alarm systems intended to provide an indication of a disturbance at the protected area to a remote surveillance position, i.e., a system central location or other selected control point. Many types of alarm systems have been developed utilizing radio transmission indication at selected frequencies, existing telephone lines or even excessive noise and lighting structure as intended merely to scare an intruder. The different types of alarm transmission networks and electrical circuits so utilized are too numerous to describe, but in previous cases the basic aim of such systems has been to conduct a disturbance indication from the disturbed area to some centralized surveillance point whereupon remedial action can be initiated. In many cases, such centralized alarm systems require extensive central station circuitry or telephone switching apparatus in order to properly carry out their protective function, such protection usually being under control and guidance of a designated legal or police authority.

SUMMARY OF THE INVENTION

The present invention contemplates a multiple station alarm system wherein a disturbance at any one station of the system will be indicated via data transmission to all remaining stations of the system with appropriate indication of the disturbed station or area such that persons located at all stations in the system will be apprised of the occurring disturbance. In a more limited aspect, the invention consists of a transmitter/-receiver assembly and associated logical and indication circuitry as located at each station of the multiple station system, each station transmitter emitting a characteristic identifying signal for that particular station which upon receipt at all other station receivers will activate frequency selective circuitry to display an indication of the one station in accompaniment with an audible alert.

Therefore, it is an oject of the present invention to provide a vigilance alarm system of relatively low cost for use in and about a multiple station surveillance area.

It is also an object of the invention to provide an apparatus for use in surveillance in and around apartment complexes, selected neighborhood areas, and the like in order to apprise all individuals in the area of any disturbance at one point or station in the area.

Finally, it is an object of the present invention to provide a radio transmission alarm circuit of uniform and standardized character which can be used in compound at any of numerous stations so that all stations will be apprised of the disturbance at one of the stations.

Other objects and advantages of the invention will be evident from the following detailed description when read in conjunction with the accompanying drawings which illustrate the invention.

DETAILED DESCRIPTION OF THE INVENTION

Figure 1:
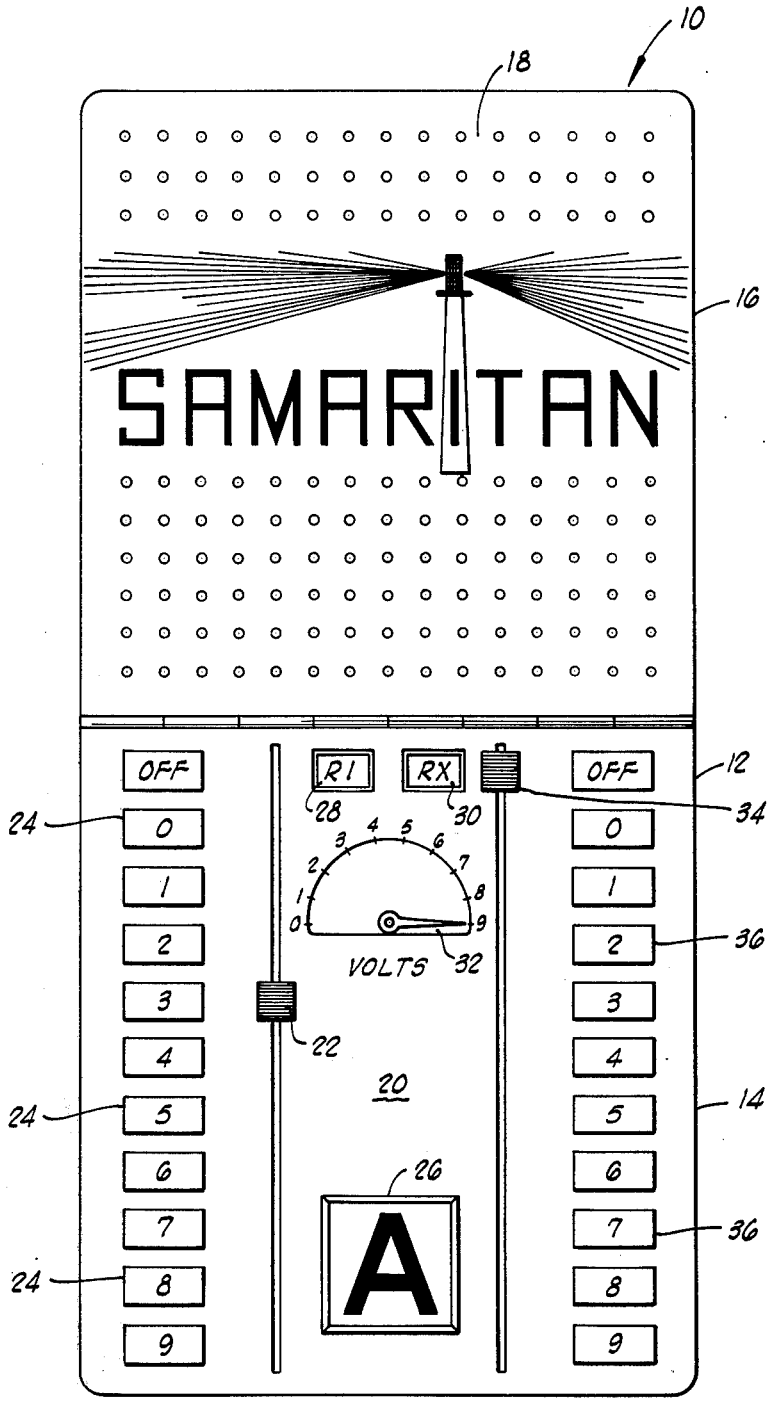
FIG. 1 is a plan view of the alarm circuit control box of the present invention as disposed in its open position.

FIG. 1 illustrates a control unit 10 as utilized in the vigilance alert system of the present invention. The control unit 10 is preferably disposed in a portable type of carrying case or metal cabinet 12 having a base portion 14 and a hinged upper lid portion 16. Hinged upper lid portion 16 may be adapted to carry an audible alarm speaker as enclosed by a perforated, and if desired decorative, facing 18, while lower or base portion 14 is adapted to carry the electronic circuitry sentry and control panel 20.

Control panel 20 includes a conventional form of slide switch 22 which selectively provides electrical continuity for any one of the decade of switch position lamps 24, i.e. positions Off through 9. A push button switch 26 provides alarm enable whenever the user depresses the switch. A push button switch R1 or switch 28 provides users reset to place the system in the non-alert status, while a push botton 30 or switch RX resets the user's control unit 10 as regards indications received from other control units, e.g. after an alert situation has been followed to conclusion and unit systems are reset upon agreement. A front panel voltage meter 32 provides continual indication as to the unit battery supply voltage so that the user is always aware of proper operating potential.

An additional slide switch 34 coacting with decade lamp indicators 36 is included to provide capability for additional user units. That is, indicators 24 provide units and indicators 36 provide tens designation. As will become apparent below, any number of users in the vigilance system may be included simply by compounding the number of user indications apparent from the indications on the front panel of control unit 10. The slide switch 34 may be a conventional type of plural position slide switch with individual contact units connected in series with individual units of slide switch 22, or the switching system may be one of the more recently developed but commercially available switching systems as intended for usage with large pluralities of control stations or user inputs.

Figure 2:
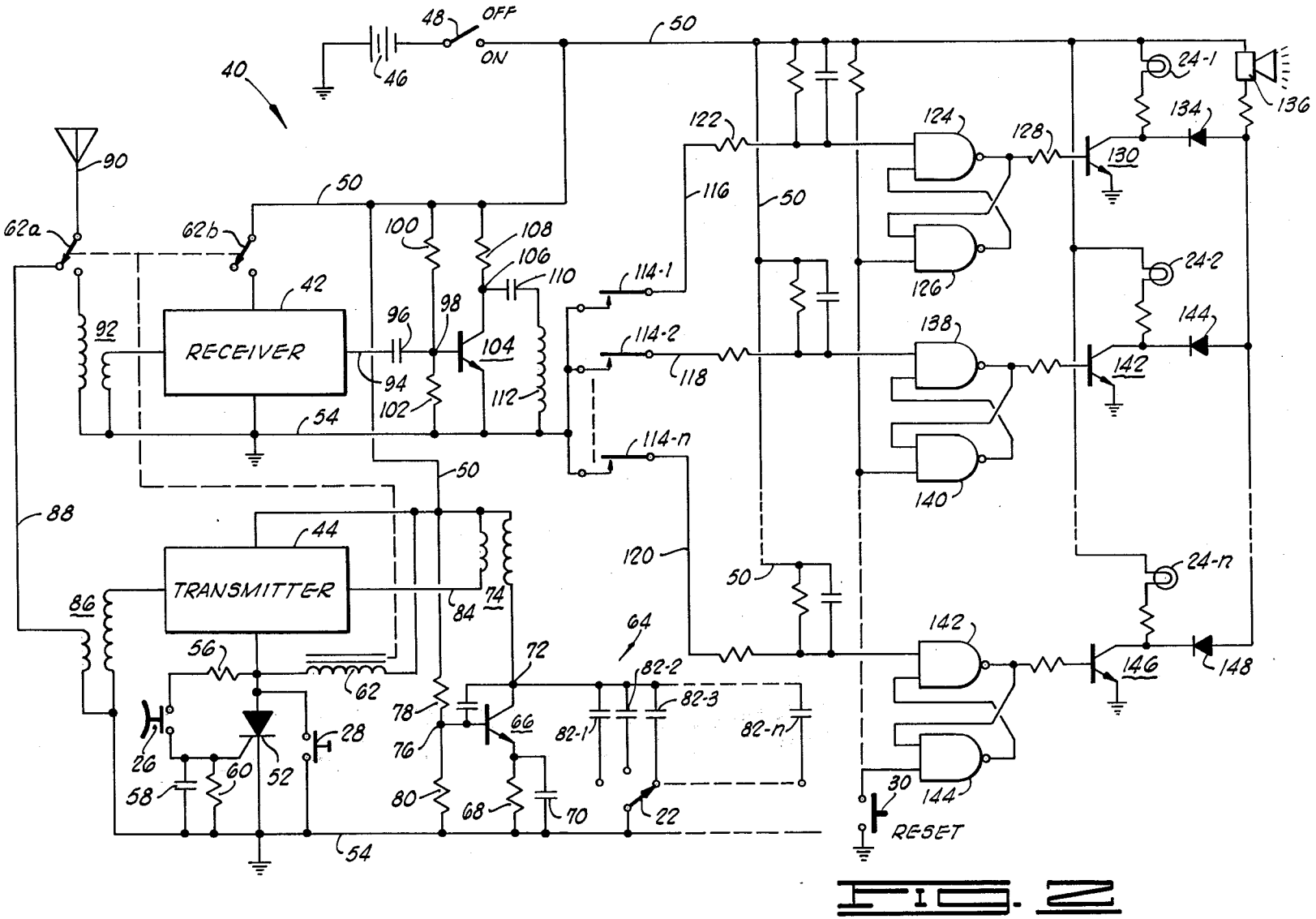
FIG. 2 is a schematic diagram of an individual alarm circuit as constructed in accordance with the present invention.

Referring now to FIG. 2, each of the respective control units 10 encloses a control circuit 40 which includes a receiver unit 42 and a transmitter unit 44. The transmitters 44 may be any of numerous commercially available transmitter units having the requisite frequency and power requirements, and in like manner the receiver 42 would be selected in order to match the frequency requirements. For example, the transmitter 44, whether AM or FM in transmission mode, might be selected to function with output at 27 megacycles, a citizens band allotment, and with a relatively low power output on the order of 100 milliwatts. The 100 milliwatt output power is consonant with the requirements of the system since it is a local oriented transmission system with no necessity for distance transmission. Such units suitable for use in transmitter 44 and receiver 42 are readily available through various commercial outlets and may be selected in accordance with the exigencies of design, and either amplitude modulation or frequency modulation concepts may be readily utilized.

Operating power for the present circuitry could be derived from any of various sources; however, the nature of the system suggests that a suitable battery source 46, e.g. a 9-volt battery unit, be utilized. Battery 46 is then supplied by an "on-off" switch 48 to a positive voltage supply lead 50 which supplies system power throughout. Thus, positive voltage on lead 50 is supplied to transmitter 44 which is energized by a user in response to a disturbance by depression of the alarm switch 26 to provide trigger voltage to a semi-conductive controlled rectifier 52 as connected between transmitter 44 and ground bus 54. A current limiting resistor 56 is connected in series with trigger actuating or alarm switch 26, and a capacitor 58 and resistor 60 are connected in parallel between the trigger electrode of SCR 52 and ground bus 54 in order to provide proper development of the trigger voltage. Actuation of transmitter 44 also energizes a relay coil 62, the transmitter relay, which actuates relay contacts 62*a* and 62*b* to isolate receiver 42 during transmission. Relay 62 is shown in its normal closed or de-energized position.

Transmitter 44, which may be transmitting at 27 megacycles in the citizens band, is modulated in the preferred form by tone modulation in order to establish the subscriber user. Thus, a tone modulator 64 may consist of an NPN transistor 66 functioning under control isolation in response to a selected feedback circuit which identifies the selected user. Transistor 66 is connected common emitter through a resistor 68 and a capacitor 70 with collector connected through a collector junction 72 to the primary of a collector transformer 74 and the positive voltage supply. Base potential is derived from a junction 76 is a voltage divider consisting of series resistors 78 and 80. Regenerative feedback from the collector junction 72 is then selectively achieved through slide switch 22 and selection of one of parallel capacitors 82-1, 82-2, 82-3 through 82-*n*. Transistor 66 functions as a conventional form of oscillator circuit under selective feedback control, and output is taken from the secondary of transformer 74 for input via lead 84 for modulation within transmitter 44. The modulated transmitter output is then present at output transformer 86 for conduction via lead 88 and normal-open position of relay contact 62a for transmission propagation via antenna 90.

When transmitter 44 is not transmitting, as would be the case of all other subscriber units, relay 62 is de-energized with relay contacts 62*a* and 62*b* in their normal-closed positions, and receiver 42 is energized to receive incoming energy from antenna 90. Energy from antenna 90 is then conducted through a conventional form of receiver input transformer 92 to receiver 42. Receiver 42 would of course be a conventional and commercially available form of receiver and tone demodulator circuitry adapted to function in coaction with transmitter 44 in order to provide a signal output by lead 94 through a coupling capacitor 96 to a junction 98. Junction 98 constitutes a voltage divider point between series resistors 100 and 102 and provides input to an NPN transistor 104 which functions common emitter with the collector connected through a junction point 106 and load resistor 108 to the positive voltage supply 50. Upon conduction of transistor 104, signal via coupling capacitor 110 discharging through a resonant reed detector coil 112 effects closure of one of reed switches 114-1, 114-2 through 114-n, in accordance with the frequency of the demodulated tone.

As will be further described, it is then the function of one output from resonant reed detector 112 to supply front panel indication to all other subscriber units. Thus, switch closure indications via leads 116, 118 through 120 (*n* channel) to their respective latching circuits will provide such indication. Detection of tone 1 at resonant reed detector switch contacts 114-1 effectively grounds lead 116 through a resistor 122 to one input of an AND gate 124, as enabled by latch input from companion AND gate 126, to provide output through a resistor 128 to the base of an NPN common emitter connected transistor 130 thereby causing conduction and illumination of lamp 132 as connected in the collector thereof. Upon conduction of transistor 130, diode 134 from the collector provides effective grounding to enable simultaneously a buzzer or other suitable audible alarm 136.

Upon detection of other tones by receiver 42, as would be indicative of other subscriber transmitter positions, the reed detector switches 114-2 through 114-*n* would enable similar front panel indications at all subscriber units 10 other than that one which is transmitting. Thus, if tone were received by receiver 42 to cause resonant reed detector 112 to depress reed switch 114-2, similar actuation via lead 118 of an AND gate 138, as latched by AND gate 140, would cause conduction of NPN transistor 142 to illuminate subscriber indicators 24-2. Also in like manner, diode 144 connection from the collector of transistor 142 would cause an energization of audible alarm 136. The same function would occur for each switch closure output from resonant reed detector 112 through the final switch position 114-*n* functioning via lead 120 through an AND gate 142 and latching gate 144 to energize NPN transistor 146 with illumination of indicator lamp 24-*n* and conduction via diode 148 to energize audible alarm 136.

Reset switching is provided in order to place each individual subscriber unit in its quiescent position. Thus, once a subscriber transmitter 44 has been energized for a period of time, the subscriber merely depresses the push button switch 28 to momentarily ground the anode of the SCR 52 and thereby cut off transmitter 44. In like manner, all other subscriber receivers can depress grounding push button switch 30 which is effective to disable all AND gate latching circuits thereby to release all audible alarms and visual indicators such that the subscriber system is again placed in ready status.

In operation, each subscriber in a network, e.g. an apartment complex, neighborhood or the like, will be equipped with a control unit 10 similar to that shown in FIGS. 1 and 2, and each subscriber will be capable of giving alarm to all other stations simply by depressing push button switch 26 to energize transmitter 44. The particular subscriber's identity will be established by his setting of slide switch 22 which may be his designated apartment or other code number to produce a characteristic tone frequency via tone oscillator 66 for input via lead 84 and modulation of transmitter 44, albeit frequency modulation or amplitude modulation. Transmitter output via antenna 90 carrying the characteristic and identifying tone modulation will then be propagated for reception by all receivers 42 of all other subscriber units.

Each of the remaining subscriber unit receivers 42 will then demodulate the tone signal for output via lead 94 to a resonant reed detector 112 which will cause switch closure and effective grounding of the selected switch 114-1 through **114-*n***, depending upon the transmitting subscriber user. This in turn actuates the respective one of the latching AND gate arrays to provide visual indication of the code number of the transmitting user at all subscriber units as well as an audible alarm indicating disturbance. Thus, all remaining subscriber user, who are in audible proximity to their respective units will be made aware of a disturbance at one of the subscriber users, and inspection of their control unit will give visual readout of that code number, apartment number, or assigned index which will identify that particular user whereat the disturbance is occurring.

The foregoing discloses a novel form of vigilance system wherein the need for central control surveillance is obviated as regards initial notice. The system enables a selected number of individuals or other entities to maintain a watchful attention to selected premises or positions while still enabling extreme flexiblity as to policing requirements, reaction and corrective methods. While the apparatus specifically set forth herein relates to primarily manually actuated functions, it should be understood that any of the numerous and well-known types of security sensors and detection devices may be utilized to actuate the present system. That is, the users transmitter 44 may be actuated not only by such as the alarm switch 26 buty by any of various automatic sensors detecting door break-in, fire, and other forms of disturbance susceptible of automatic detection, as is well-known in the art. The system is entirely adaptable for use with a multitude of present day security sensors to provide indication of distrubance at one subscriber position to all remaining subscriber positions.

Changes may be made in the combination and arrangement of elements as heretofore set forth in the specification and shown in the drawings; it being understood that changes may be made in the embodiments disclosed without departing from the spirit and scope of the invention as defined in the following claims.

What is claimed is:

1. Combination apparatus for transmitting and receiving alarm indication as used in plurality to consititue a vigilance alarm network, comprising:

transmitter means which is energizable for selectively generating a preselected tone modulated output transmission signal of selected frequency, said tone modulation being a selected one of a plurality of tone frequencies;

receiver means tuned to receive and demodulate an output transmission signal at said selected frequency and to produce output of a tone signal at a selected one of the plurality of tone frequencies;

resonant switch means receiving input of said tone signal and providing an output indication at one of plural outputs each responsive to a different predetermined one of said plurality of tone frequencies;

plural gate means each receiving input from a respective one of said resonant switch means plural outputs to generate a characteristic gate output in response to switch means output indication; and plural indicators each connected for energization by a respective one of said gate outputs.

2. Apparatus as set forth in claim 1 wherein said transmitter further comprises:

oscillator means generating tone signal input for modulation in said transmitter means; and switch means controlling the oscillator means regeneration to provide a selected one of a plurality of tone signals.

3. Apparatus as set forth in claim 1 which further includes: antenna means; and means responsive to transmitter energization to connect said antenna to said transmitter means output while disconnecting the receiver means input.

4. Apparatus as set forth in claim 2 which further includes:

a control box housing said apparatus and providing a control panel which includes said switch means selecting the transmitter means tone modulation signal, said plural indicators, and means for energizing said transmitter means.

5. Apparatus as set forth in claim 4 which is further characterized to include:

first reset switch means accessible on said control panel to de-energize said transmitter means; and second reset switch means accessible on said control panel to de-energize said plural indicators.

6. A vigilance alarm system comprising:

a plurality of transmitter-receiver units with each unit disposed at a designated location and identifiable by a characteristic tone frequency, each transmitter-receiver unit being comprised of:

transmitter means which is energizable for selectively generating a preselected tone modulated output transmission signal of selected frequency, said tone modulation being a selected one of a plurality of tone frequencies;

receiver means tuned to receive and demodulate an output transmission signal at said selected frequency and to produce output of a tone signal at a selected one of the plurality of tone frequencies;

resonant switch means receiving input of said tone signal and providing an output indication at one of plural outputs each responsive to a different predetermined one of said plurality of tone frequencies;

plural gate means each receiving input from a respective one of said resonant switch means plural outputs to generate a characteristic gate output in response to switch means output indication; and plural indicators each connected for energization by a respective one of said gate outputs.

7. A vigilance system as set forth in claim 6 wherein each of said transmitter-receiver means further comprises:

oscillator means generating tone signal input for modulation in said transmitter means;

switch means controlling the oscillator means regeneration to provide a selected one of a plurality of tone signals; and a control box housing said apparatus and providing a control panel which includes said switch means selecting the transmitter means tone modulation signal, said plural indicator, and means for energizing said transmitter means.

* * * * *